United States Patent [19]

Ault

[11] Patent Number: 4,717,432

[45] Date of Patent: Jan. 5, 1988

[54] VARIED HEATING RATE SOLUTION HEAT TREATMENT FOR SUPERALLOY CASTINGS

[75] Inventor: Earle A. Ault, South Windsor, Conn.

[73] Assignee: United Technologies Corporation, Hartford, Conn.

[21] Appl. No.: 849,938

[22] Filed: Apr. 9, 1986

[51] Int. Cl.[4] ..... C22F 1/10

[52] U.S. Cl. ..... 148/162; 148/404; 148/410

[58] Field of Search ..... 148/162, 13, 404, 409, 148/410

[56] References Cited

U.S. PATENT DOCUMENTS

| | | | |
|---|---|---|---|
| 2,798,827 | 7/1957 | Hanink | 148/3 |
| 3,310,440 | 3/1967 | Piearcey | 148/13 |
| 3,494,709 | 2/1970 | Piearcey | 416/232 |
| 3,753,790 | 8/1973 | Walker et al. | 148/3 |
| 3,783,032 | 1/1974 | Walker et al. | 148/3 |
| 4,116,723 | 9/1978 | Gell et al. | 148/3 |
| 4,209,348 | 6/1980 | Duhl et al. | 148/3 |

*Primary Examiner*—R. Dean

*Attorney, Agent, or Firm*—James M. Rashid

[57] ABSTRACT

Methods for heat treating cast, nickel base superalloy articles are described. According to the invention, the articles are heated to progressively higher temperatures greater than the gamma prime solvus temperature and less than the incipient melting temperature. The incipient melting temperature is increased due to homogenization of segregate phases, while at the same time, the gamma prime goes into solution. The rate at which the temperature is increased closely approximates the rate at which the incipient melting temperature increases due to homogenization.

9 Claims, 3 Drawing Figures

VARIED HEATING RATE SOLUTION HEAT TREATMENT FOR SUPERALLOY CASTINGS

TECHNICAL FIELD

This invention relates to the heat treatment of cast nickel base superalloy articles.

BACKGROUND ART

Superalloys are metallic materials, usually based on nickel or cobalt, which have especially useful properties at temperatures of about 1,400° F. and above. Nickel base superalloys derive much of their strength from the presence of a strengthening phase precipitate typically referred to as gamma prime $Ni_3(Al, Ti)$; the amount of and morphology of the gamma prime phase strongly affects the mechanical properties of these materials. Gamma prime precipitates may be solutioned into the alloy matrix when heated above the solvus temperature.

Superalloy articles sometimes also contain as-cast, segregated phases which melt at a temperature which is below the liquidus temperature of the article. Such low temperature melting is called incipient melting, and its presence in a casting can compromise the mechanical properties of the casting. The fact that the incipient melting temperature is sometimes in the same range as the gamma prime solvus temperature complicates the heat treatment of such alloys.

Heat treatments for various superalloys are described in, e.g., U.S. Pat. Nos. 2,798,827, 3,310,440, 3,753,790, 3,783,032, 4,209,348, 4,116,723, and 4,583,608. Several of these patents teach that the incipient melting temperature of nickel base superalloy castings may be increased by slowly heating the casting to a temperature just below its incipient melting point. Such heating causes some of the segregate phases to diffuse into the alloy matrix, thereby increasing the casting's incipient melting point. The temperature of the article may then be further increased, which allows for more diffusion of segregate phases into the matrix, and a further increase in the incipient melting point. U.S. Pat. Nos. 3,753,790 and 3,783,032 and U.S. Ser. No. 501,662 describe one such heat treatment for nickel base superalloy castings, wherein the article is heated to a first temperature and held at that temperature to permit diffusion of the segregate phases, and then heated and held in a stepwise fashion to a series of higher temperatures, as shown in FIG. 1. Alternative heat treatment cycles are described in the U.S. Pat. Nos. 3,753,790 and 3,783,032 patents: after the initial hold at the first temperature, the castings are heated at a gradual but continuous (constant) rate to a maximum temperature $T_{max}$ to further diffuse the segregate phases into the matrix. Such a heat treatment cycle is shown in FIG. 2.

Both the step temperature and constant rate heat treatment cycles of the prior art are lengthy; since the cost of a heat treatment increases with time, engineers have sought improved cycles to produce castings with optimum properties, wherein the heat treatment time is minimized.

SUMMARY OF THE INVENTION

According to the invention, a method for heat treating a cast nickel base superalloy article which contains gamma prime strengthening phases and low melting temperature segregated phases comprises heating the article to predetermined, progressively increasing temperatures which are greater than the gamma prime solvus temperature and less than the incipient melting temperature, wherein the rate R at which the temperature increases per unit time between each pair of successive, predetermined temperatures closely approximates the rate at which the incipient melting temperature increases between the same pair of successive temperatures. More specifically, the article temperature versus time curve defines a series of ramps, wherein between any two successive, predetermined temperatures, the slope of each ramp closely approximates the slope of the incipient melting temperature versus time curve. There are no intentional holds at any of the predetermined temperatures less than $T_{max}$, and the rates R are chosen to maximize the rate of segregate homogenization and gamma prime solutioning, and to minimize any incipient melting.

The temperature is maintained at $T_{max}$ for a time sufficient to solutionize substantially all of the gamma prime and to homogenize substantially all of the segregate phases, after which the article is rapidly cooled below the gamma prime solvus temperature in order to prevent the precipitation of gamma prime or segregate phases. Alternatively, the article may be rapidly cooled immediately after it reaches $T_{max}$. Finally, the article is aged at a temperature chosen to reprecipitate and grow the gamma prime phase to a desired morphology.

For the purposes of this specification and claims, the rate R between successive, predetermined temperatures "closely approximates" the rate at which the incipient melting temperature increases between such temperatures if the instantaneous difference between the article temperature and its incipient melting temperature is less than at least about 35° F.; preferably the difference is less than about 20° F. Further, the term "substantially all" as used with respect to the amount of solutioned gamma prime and homogenized segregate phases is a term readily understood by those skilled in the art; see, e.g., U.S. Pat. Nos. 3,753,790, 3,783,032, 4,116,723 and 4,209,348, all of which are incorporated by reference. Finally, "segregate phases" are any phases which melt at a temperature which is less than the alloy's normal melting (solidus) temperature, including, e.g., segregation within the matrix gamma phase.

Progressively increasing the temperature of the article above the gamma prime solvus temperature, without holding (soaking) until $T_{max}$ is reached, reduces the heat treatment time and expenses compared to prior art techniques. The invention improves upon prior art techniques, which, e.g., failed to realize that soaks at intermediate temperatures are not necessary to successfully heat treat gamma prime strengthened nickel base alloys. The invention is particularly useful in heat treating directionally solidified single crystal or columnar grain nickel base superalloy articles. One example of single crystal castings which may be heat treated according to the invention have the following composition (by weight percent): about 8–12 Cr, 3–7 Co, 3–5 W, 1–2 Ti, 10–14 Ta, 4.5–5.5 Al, with the balance Ni. Articles having such a composition may be heat treated as follows: heat the articles from room temperature to about 2,250° F. in at least about 1 hour; then raise the article temperature from 2,250° F. to about 2,300° F. at a rate of about 2½° F. per minute; from 2,300° F. to about 2,310° F. at about 1° F. per minute; from 2,310° F. to 2,320° F. at about 1° F. per three minutes; from 2,320° F. to 2,330° F. at about 1° F. per 3½ minutes; from 2,330° F. to 2,350° F. at about 1° F. per 5 minutes; from 2,350° F.

to 2,365° F. at about 1° F. per 10 minutes; hold at 2,365° F. for 30 minutes to solution substantially all of the gamma prime phase into the gamma phase matrix and to homogenize substantially all of the segregate phases into the gamma phase matrix. After holding at 2,365° F. ($T_{max}$), the articles are rapidly cooled to below about 2,100° F. at a rate of at least about 115° F. per minute, and then to below about 800° F. at a rate of air cool or faster, in order to retain the solutioned and homogenized microstructure. Finally, the articles are aged at about 1,600° F. for 32 hours, which results in a microstructure which contains gamma prime precipitates in a gamma matrix, the gamma prime precipitates having a nominal size of less than about 0.5 microns.

Tests have shown that mixed batches of large and small castings may be simultaneously heat treated according to the invention techniques, which indicates that the usefulness of the invention is not dependent upon the geometry of the article being heat treated. Because the amount of segregation in castings generally increases as the size and complexity of the cast article increases, it has been found that prior art heat treatment cycles cannot readily be used to heat treat mixed batches of castings. In the invention, the rate at which the temperature of the castings increases is slow enough to permit uniform heating of the articles, regardless of their geometry, without the need for extended, intentional soaks at temperatures less than $T_{max}$.

Tests have also shown that compared to articles heat treated with prior art techniques, the articles treated according to the invention show a significant reduction in the tendency to recrystallize. Further, the amount of incipient melting observed in articles heat treated according to the invention, if present at all, is considerably less than the amount of melting observed in articles heat treated with prior art techniques. If the temperature of the casting should unintentionally exceed the incipient melting point, the slow heating rate limits the degree of melting. The detrimental effects of such incipient melting may be alleviated, or healed, by performing a subsequent varied rate heat treatment which is similar to the one previously performed, but wherein the predetermined temperatures and/or rates are slightly lowered. The elimination of incipient melting thereby permits the use of castings which would otherwise be scrapped.

The foregoing and other objects, features and advantages of the present invention will become more apparent from the following description of the preferred embodiment and accompanying drawings.

BEST MODE FOR CARRYING OUT THE INVENTION

The present invention is an improvement over prior art methods for heat treating superalloys which contain low melting segregate phases as well as strengthening precipitate phases such as gamma prime. Use of the invention heat treatment is particularly desirable because it reduces the heat treatment time as compared to prior art methods, which reduces its cost.

Figure 1:
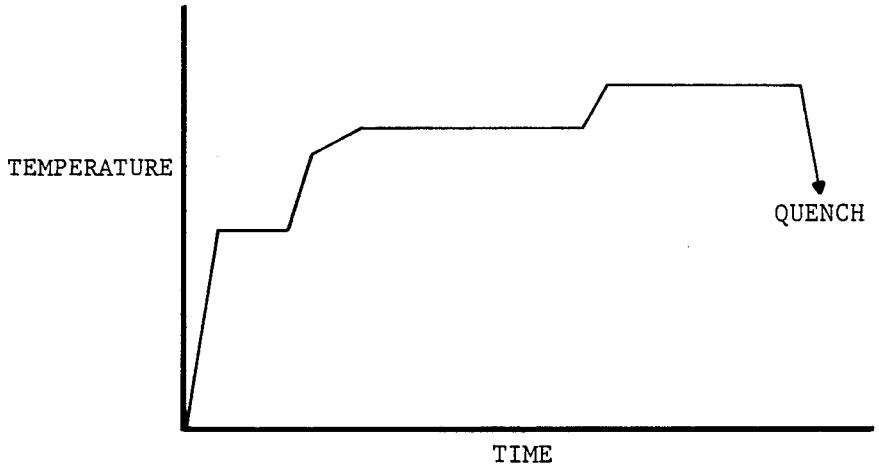
FIG. 1 PRIOR ART
FIGS. 1 and 2 schematically illustrate prior art heat treatment cycles.
Figure 2:
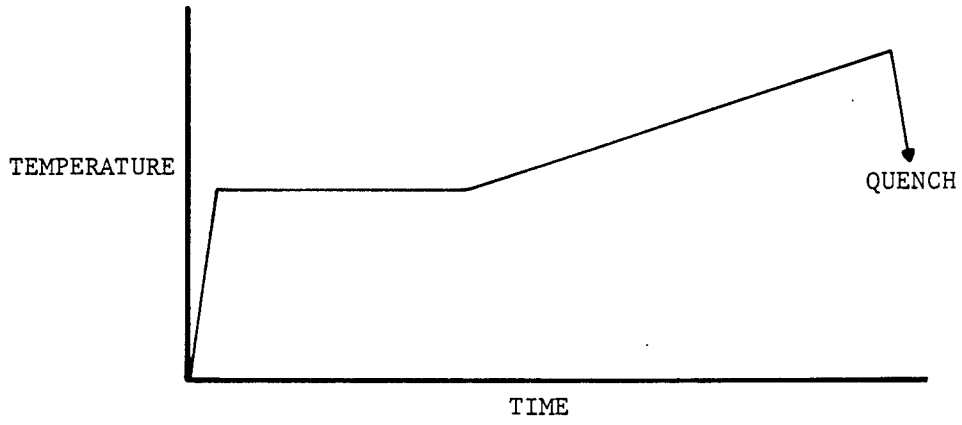
FIG. 2 PRIOR ART
Figure 3:
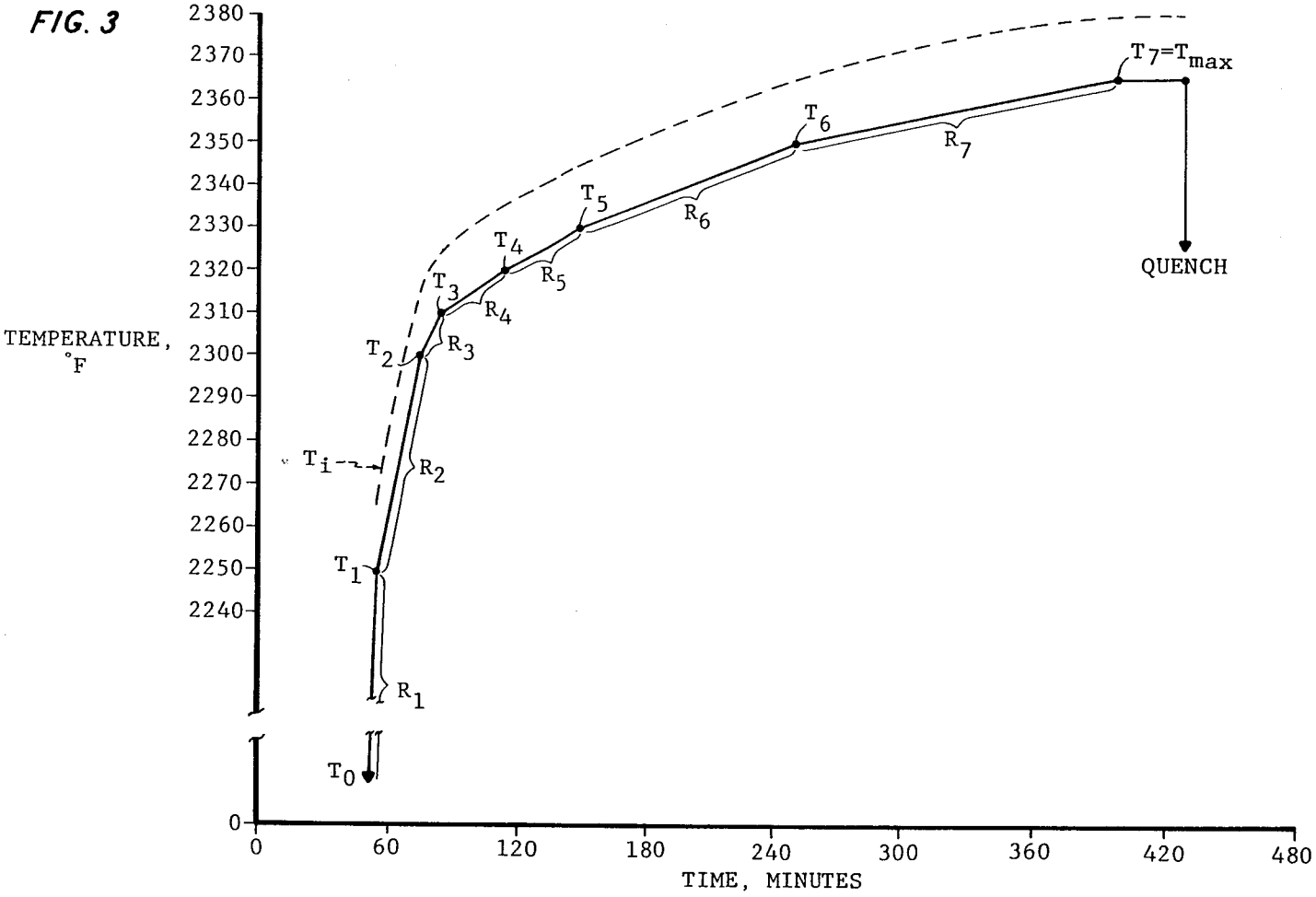
FIG. 3 illustrates a heat treatment cycle according to the invention, particularly useful with the alloy described in Example I.

FIG. 3 illustrates the invention method for heat treating a cast nickel base superalloy article which contains a strengthening precipitate phase such as gamma prime which goes into solution at a solvus temperature $T_s$, and which also contains segregate phases which melt at an incipient melting temperature $T_i$. The dotted line in the Figure is intended to show the approximate change in the incipient melting temperature $T_i$ during the invention heat treatment cycle. According to the invention, starting at about room temperature $T_0$, the article is quickly heated to temperature $T_1$, at a rate of temperature increase (° F. per unit time) of $R_1$. $T_1$ is below but within about 35° F. of the incipient melting temperature $T_i$. Depending on the difference between the solvus temperature and the incipient melting temperature for the particular alloy being heat treated, $T_1$ may be greater or less than the solvus temperature. Since one object of the invention is to reduce the overall heat treatment time, the rate of temperature increase $R_1$ is as fast as possible, within of course the limitations of the particular furnace being utilized. Generally, $R_1$ should be at least about 40° F. per minute.

Upon reaching $T_1$, and without intentionally holding at $T_1$, the rate of temperature change is decreased to $R_2$, and maintained at such rate until the temperature of the article reaches predetermined temperature $T_2$. As is seen in FIG. 3, during the time that the temperature increases from $T_1$ to $T_2$, the incipient melting temperature $T_i$ also increases so that $T_2$ is less than $T_i$. Referring to the Figure, the temperature of the article is then raised to predetermined, progressively increasing temperatures $T_3$, $T_4$, $T_5$, $T_6$, and then to the maximum temperature $T_{max}=T_7$. The rate at which the temperature is increased from $T_2$ to $T_3$ is $R_3$; from $T_3$ to $T_4$ is $R_4$; and analogously for the remaining temperatures and rates. There are no intentional holds at the predetermined temperatures less than $T_{max}$. Of course, it should be appreciated that $T_{max}$ need not correspond exactly to the last of seven such predetermined temperatures. However, FIG. 3 shows $T_{max}$ as $T_7$ for reasons which will become apparent in Example I, below. The specific temperatures T and rates R are determined by metallographic examination, generally in accordance with the teachings of U.S. Pat. Nos. 3,753,790 and 3,783,032, which are incorporated by reference. Briefly, this requires performing numerous tests to determine the particular predetermined temperatures T and the rate R between each pair of successive, predetermined temperatures which produce a maximum amount of gamma prime solutioning and segregate phase homogenization without incipient melting. The results of these tests are then used to define the optimum heat treatment cycle, i.e., one that produces the desired microstructure in the minimum amount of time.

The temperature of the article is maintained at $T_7$ for a period of time to insure that substantially all of the gamma prime phase is solutioned and substantially all of the segregated phase is homogenized into the gamma phase matrix. Depending on the specific alloy being heat treated, holding at $T_7$ may not be necessary. That is, the article may be cooled immediately on reaching $T_7$. Whether or not there is a hold at $T_7$, the article is gas quenched or otherwise rapidly cooled to below $T_s$ at a rate which is fast enough to retain the solutioned and homogenized microstructure. The article is then aged at appropriate temperatures to reprecipitate and coarsen the gamma prime phase, and to produce a desired microstructure and properties.

It should be noted that temperatures are not considered to be "predetermined" unless the rates between successive ones of such temperatures are different (i.e., not equal).

Solutioning of the gamma prime phases and homogenization of the segregate phases are both diffusion controlled processes. As such, the rates at which such processes occur is an exponential function of the temperature of the article. In the invention heat treatment, both of these diffusion controlled processes are forced to occur at relatively high rates because the temperature is continually being increased. This is unlike prior art techniques, where the temperature is either increased only after lengthy holds at intermediate temperatures, or at a constant rate with little consideration given to the resultant change in incipient melting temperature.

Between any two predetermined temperatures T, there is a desired rate of temperature increase R which will produce a maximum amount of homogenizing and solutioning. Even though further increases in any particular rate R may increase the amount of homogenizing and solutioning, it will also undesirably increase the possibility of incipient melting. Therefore, the predetermined temperatures T and the respective rates R between successive pairs of predetermined temperatures should be chosen to maximize the amount of homogenizing and solutionizing, while still providing an adequate cushion between the article temperature and incipient melting temperature. A cushion of at least about 35° F. is considered adequate, although for various alloys and components, 10°-20° F. may be used.

Still referring to FIG. 3, the article temperature versus time curve represents a series of ramps, wherein between successive, predetermined temperatures, the slope of each ramp closely approximates the slope of the incipient melting temperature versus time curve. There are no intentional holds at any predetermined temperature less than $T_{max}$ and, as noted above, the temperature of the article between successive, predetermined temperatures should always be below but within about 35° F. of the incipient melting temperature.

It should be noted that while FIG. 3 shows a series of ramps, or segments which define the rate of temperature increase R between the predetermined temperatures $T_i$, $T_2$, etc., it is within the scope of the invention that the rates R change between predetermined temperatures T which differ by only a few degrees. In such case, the segments would be very short, and the plot of temperature versus time would approximate a smooth curve.

Specific aspects of the invention may be better appreciated by reference to the following examples which are meant to be illustrative rather than limiting.

EXAMPLE I

The nickel base superalloy described in U.S. Pat. No. 4,209,348, having a composition of, by weight percent, about 8-12 Cr, 3-7 Co, 3-5 W, 1-2 Ti, 10-14 Ta, 4.5-5.5 Al, with the balance Ni, was cast into a single crystal article according to the teachings of U.S. Pat. Nos. 3,260,505 and 3,494,709. Incipient melting in single crystal castings having this composition has been observed at temperatures in the range of about 2,300°-2,350° F.; the gamma prime precipitate begins to go into solution at about 2,250° F. It should be noted, however, that slight differences in composition, solidification techniques and article geometry may result in differences in the solvus and incipient melting points. Additionally, even within the same casting, there may be slight differences in solvus and incipient melting points. Such differences in the solvus and incipient melting point makes the heat treatment of this type of alloy article difficult. The need to overcome these difficulties led, in part, to the present invention.

To heat treat single crystal castings having the aforementioned composition, the article is initially heated in a protective atmosphere from room temperature $T_0$ (FIG. 3) to a temperature $T_1$ of about 2,250° F. at a rate $R_1$ of at least about 40° F. per minute. Once the temperature of the article exceeds the solvus temperature $T_s$, the gamma prime phase begins to go into solution in the gamma matrix, and continues to do so during the remainder of the heat treatment process. When the article reaches $T_1$, the temperature is raised to $T_2$, at a rate of temperature increase $R_2$ which is less than $R_1$. There is no intentional hold at $T_1$. Of course, depending on the type of heat treating furnace being used, there may be some delay in changing the rate of temperature increase from $R_1$ to $R_2$ when $T_1$ is reached. Such an unintentional delay may result in the temperature remaining at $T_1$ for a short period of time, but for the purposes of this specification and attached claims, is not considered an isothermal hold or soak. The temperature $T_2$ is about 2,300° F., and $R_2$ is about 2½° F. per minute. Note that the slope of the article temperature versus time curve between $T_2$ and $T_1$ closely approximates the slope of the incipient melting curve between $T_2$ and $T_1$. For the particular aforementioned alloy composition, the difference between the incipient melting temperature and the article is preferably no greater than about 20° F. Most preferably, the difference is no greater than 10° F. Throughout the heat treatment cycle, as the article is heated to successive, predetermined temperatures, the difference between the article temperature and the incipient melting temperature is kept as small as possible, which insures that maximum advantage is being taken of the solid state diffusion process. That is, as the incipient melting point increases, the article temperature is increased accordingly, which ultimately reduces the total heat treatment time. From $T_2$, the temperature is increased to $T_3$ (2,310° F.) at a rate $R_3$ of about 1° F. per minute, and again, the slope of the temperature versus time curve between $T_2$ and $T_3$ closely approximates the slope of the incipient melting curve. Table I below presents the entire heat treatment cycle shown in FIG. 3, including the remaining temperatures $T_4$, $T_5$, $T_6$ and $T_7$, and corresponding rates $R_4$, $R_5$, $R_6$, $R_7$ for single crystal castings made of the aforementioned alloy. Note that there are no intentional holds at temperatures less than $T_7 = T_{max}$.

TABLE I

Varied Rate Heat Treatment Cycle

| Heating Rate, R | Temperature, T (°F.) |
|---|---|
| $R_1$ 40° F. per minute | $T_1$ 2,250 |
| $R_2$ 2½° F. per minute | $T_2$ 2,300 |
| $R_3$ 1° F. per minute | $T_3$ 2,310 |
| $R_4$ 1° F. per 3 minutes | $T_4$ 2,320 |
| $R_5$ 1° F. per 3½ minutes | $T_5$ 2,330 |
| $R_6$ 1° F. per 5 minutes | $T_6$ 2,350 |
| $R_7$ 1° F. per 10 minutes | $T_7$ 2,365 |

The article should be held at $T_7 = T_{max}$ for about 30 minutes in order to assure that substantially all of the gamma prime phase which is detectable at 100X magnification, with the exception of any eutectic gamma prime islands or pools, is solutionized. While eutectic gamma prime pools are technically considered a segregated phase, a sufficient amount of homogenization takes place during the varied rate heat treatment cycle to permit the solutioning of substantially all of the precipitate gamma prime without the occurrence of detrimental incipient melting. When this criterion has been met, substantially all of the segregate phases are considered to have been homogenized. The article is then cooled to below about 2,100° F. at a rate of about 115° F. per minute, then below about 800° F. at air cool or faster. Aging at about 1,975° F. for 4 hours may be performed subsequent to the quenching operation. Then the article is heated to about 1,600° F. for 32 hours to precipitate the gamma prime phase in a desired morphology. Preferably, the gamma prime will be less than about 0.5 microns in size; most preferably between 0.3 and 0.5 microns. There may be occasional carbides or islands of eutectic gamma prime in the microstructure, but generally, at low magnifications of 100X, the microstructure is featureless.

EXAMPLE II

As is generally known, the strength of alloys such as the one described in Example I can be increased by increasing the Al+Ti content. However, such aluminum and titanium additions adversely affect the ability to heat treat the resultant castings, due to an increase in segregation and a decrease in the incipient melting temperature. The single crystal castings of Example I, containing a high Al+Ti content of 6.3 weight percent, were successfully heat treated to $T_1$ equal to 2,300° F. at a fast rate of about 40° F. per minute. Without intentionally holding at $T_1$ the temperature was raised to $T_2$ equal to about 2,335° F. at a rate of about 1° F. per minute. Then the temperature was raised to about 2,365° F., which corresponded to $T_3=T_{max}$. The rate of temperature increase between $T_2$ and $T_3$ was about 1° F. per 6 minutes. Metallographic examination of the castings after they were held at $T_3$ for 1 hour and then quenched revealed some occasional incipient melting with a few sites of undersolutioned (coarse) gamma prime. The heat treatment was judged to be acceptable, and the results were better than those achieved with prior art methods.

Although this invention has been shown and described with respect to a preferred embodiment, it will be understood by those skilled in the art that various changes in form and detail thereof may be made without departing from the spirit and scope of the claimed invention.

I claim:

1. A method for heat treating a cast nickel base superalloy article having a gamma phase matrix and containing gamma prime strengthening phases and low melting temperature segregated phases, the strengthening phases having a solvus temperature $T_s$ and the segregated phases having an incipient melting temperature $T_i$, comprising raising the temperature of the article to predetermined, progressively increasing temperatures greater than $T_s$ and less than $T_i$ to a maximum temperature $T_{max}$, and then rapidly cooling the article to below $T_s$, wherein the rate of temperature increase between successive ones of said predetermined temperatures closely approximates the rate at which the incipient melting temperature is not constant, and increases between said successive ones of said predetermined temperatures, and there are no intentional holds at temperatures less than $T_{max}$, wherein substantially all of the gamma prime phase is solutioned and substantially all of the segregate phases are homogenized.

2. The method of claim 1, wherein said rate of temperature increase between successive ones of said predetermined temperatures constantly decreases.

3. The method of claim 2, wherein the temperature of the article between said predetermined temperatures is always within at least about 20° of the incipient melting temperature.

4. The method of claim 2, further comprising the step of aging the heat treated article to cause the solutioned gamma prime phase to precipitate and grow in a desired morphology.

5. A method for heat treating a cast nickel base superalloy article having a gamma phase matrix and containing gamma prime strengthening phases and low melting temperature segregated phases, the strengthening phases having a solvus temperature $T_s$ and the segregated phases having an incipient melting temperature $T_i$, wherein $T_s<T_i$, comprising the steps of:

(a) heating the article to a temperature $T_1$ which is greater than $T_s$ and below but within about 35° F. of $T_i$, wherein the gamma prime phase starts to go into solution in the gamma phase matrix, and the segregated phases start to be homogenized in the gamma phase matrix, wherein homogenization of the segregate phases causes the incipient melting temperature to increase;

(b) without intentionally holding at $T_1$, increasing the temperature of the article to predetermined, progressively higher temperatures $T_2$, $T_3$, $T_4$, . . . , $T_{max-1}$ at progressively lower rates $R_2$, $R_3$, $R_4$, . . . , $R_{max-1}$, respectively without intentionally holding at said predetermined temperatures, said temperatures being below but within about 35° F. of $T_i$, wherein solutioning of the gamma prime phase and homogenization of the segregated phases continues and the incipient melting point is further increased;

(c) without intentionally holding at $T_{max-1}$, increasing the temperature of the article to $T_{max}$ at a rate of temperature increase of $R_{max}<R_{max-1}$, and intentionally holding at $T_{max}$ for a time sufficient to solutionize substantially all of the gamma prime phase and to homogenize substantially all of the segregated phases, wherein $T_{max}$ is below but within about 35° F. of $T_i$;

(d) cooling the article to a temperature below $T_s$ at a rate sufficient to retain the solutioned microstructure and prevent the precipitation or coarsening of the strengthening phases; and (e) aging the article to cause precipitation and growth of strengthening phases having an optimum morphology.

6. A method for heat treating a cast single crystal superalloy article consisting essentially of, by weight percent, about 8–12 Cr, 3–7 Co, 3–5 W, 1–2 Ti, 10–14 Ta, 4.5–5.5 Al, with the balance Ni, comprising the steps of (a) heating the article to a temperature $T_1$ of about 2,250° F. at a rate $R_1$ of at least about 40° F. per minute;

(b) without intentionally holding at $T_1$, heating the article from $T_1$ to a temperature $T_2$ of about 2,300° F. at a rate $R_2$ of about 2½° F. per minute;

(c) without intentionally holding at $T_2$, heating the article from $T_2$ to a temperature $T_3$ of about 2,310° F. at a rate $R_3$ of about 1° F. per minute;

(d) without intentionally holding at $T_3$, heating the article from $T_3$ to a temperature $T_4$ of about 2,320° F. at a rate $R_4$ of about 1° F. per 3 minutes;

(e) without intentionally holding at $T_4$, heating the article from $T_4$ to a temperature $T_5$ of about 2,330° F. at a rate $R_5$ of about 1° F. per 3½ minutes;

(f) without intentionally holding at $T_5$, heating the article from $T_5$ to a temperature $T_6$ of about 2,350° F. at a rate $R_6$ of about 1° F. per 5 minutes;

(g) without intentionally holding at $T_6$, heating the article from $T_6$ to a temperature $T_7$ of about 2,365° F. at a rate $R_7$ of about 1° F. per 10 minutes;

(h) holding the article at $T_7$ for about 30 minutes;

(i) cooling the article to below about 2,100° F. at a rate of at least about 115° F. per minute; and (j) aging the article at about 1,600° F. for at least about 32 hours.

7. A method for heat treating a nickel base superalloy article having a gamma phase matrix and containing gamma prime strengthening phases and low melting temperature segregated phases, the strengthening phases having a solvus temperature $T_s$ and the segregated phases having an incipient melting temperature $T_i$, wherein $T_s<T_i$, the method comprising the steps of heating the article to a maximum temperature $T_{max}$, wherein $T_s<T_{max}<T_i$, wherein there are no intentional holds at temperatures less than $T_{max}$, and the rate of temperature increase between $T_s$ and $T_{max}$ is not constant; and then rapidly cooling the article to below $T_s$.

8. The method of claim 7, wherein the rate of temperature increase between $T_s$ and $T_{max}$ decreases as the temperature of the article increases.

9. A method for heat treating a nickel base superalloy article having a gamma phase matrix and containing gamma prime strengthening phases and low melting temperature segregated phases, the stregthening phases having a solvus temperature $T_s$ and the segregated phases having an incipient melting temperature $T_i$, wherein $T_s<T_i$, the method comprising the steps of heating the article to a maximum temperature $T_{max}$, wherein $T_s<T_{max}<T_i$, wherein the rate of temperature increase between $T_s$ and $T_{max}$ is not constant, and the temperature versus time curve up to $T_{max}$ has a nonzero slope; and then rapidly cooling the article to below $T_s$.

* * * * *

UNITED STATES PATENT AND TRADEMARK OFFICE

CERTIFICATE OF CORRECTION

PATENT NO. : 4,717,432

DATED : January 5, 1988

INVENTOR(S) : EARLE A. AULT

It is certified that error appears in the above-identified patent and that said Letters Patent is hereby corrected as shown below:

Column 7, line 61, claim 1, after "temperatures" insert --is not constant, and--.

Column 7, line 63, claim 1, delete "is not constant, and" after the word "temperature".

Column 10, line 13, claim 9, "stregthening" should read --strengthening--.

Signed and Sealed this

Third Day of March, 1992

*Attest:*

HARRY F. MANBECK, JR.

*Attesting Officer*

*Commissioner of Patents and Trademarks*